US006827674B1

(12) United States Patent
Ferry

(10) Patent No.: US 6,827,674 B1
(45) Date of Patent: Dec. 7, 2004

(54) KICK-BOXING BAG

(76) Inventor: Mark W. Ferry, 115 Valley Dr., Florence, KY (US) 41042

( * ) Notice: Subject to any disclaimer, the term of this patent is extended or adjusted under 35 U.S.C. 154(b) by 387 days.

(21) Appl. No.: 09/849,674

(22) Filed: May 7, 2001

(51) Int. Cl.[7] ..... A63B 21/00
(52) U.S. Cl. ..... 482/83; 482/87; 482/90
(58) Field of Search ..... 482/83–90; 220/501, 220/740, 903, 504, 916

(56) References Cited

U.S. PATENT DOCUMENTS 4,103,889 A * 8/1978 Lobur ..... 482/87
5,037,087 A * 8/1991 Roth
5,564,583 A * 10/1996 Kelly et al.
5,765,712 A * 6/1998 Skinner
6,106,443 A * 8/2000 Kuo ..... 482/87
6,558,298 B2 * 5/2003 Fields et al.

* cited by examiner

*Primary Examiner*—Jerome W. Donnelly

(57) ABSTRACT

The disclosed invention relates to an exercise bag specifically designed to accommodate the practice routines of the martial arts and kick-boxing practitioner. The bag features a suspendable enclosure having a bottom, a removable top and a continuously curving side. The enclosure is fabricated from a durable material and encloses a padded structure which, in turn, envelopes a water-tight resilient container that can be easily removed and re-inserted to facilitate toting.

2 Claims, 3 Drawing Sheets

KICK-BOXING BAG

BACKGROUND OF THE INVENTION

This invention relates generally to an exercise bag that is used for striking, usually with the foot, as part of an exercise routine or practice associated with one of the numerous martial arts that are currently in vogue as part of a fitness regimen. More specifically, the disclosed bag can be used as a resistance target in karate, tai kwan do, kick-boxing or any of the variations thereof.

DESCRIPTION OF THE PRIOR ART

Exercise bags have been part of the exercise environment for years. For example, U.S. Pat. No. 291,015, issued Dec. 25, 1883 to Rumsey, describes efforts to provide an air-tight bag offering a large surface area and light weight resulting in a bag with quicker movements and thereby allegedly affording a better form of exercise for the striker.

G.B. Patent 432,056, issued Jul. 19, 1935 to Mallin describes a punching bag having an internal bladder that may be wholly or partially filled with water. The water content of the bag can be varied to alter the weight add, to some extent, the "yieldingness" of the bag. This bag is also equipped with straps to facilitate suspension.

U.K Patent Application 2,084,028, published Apr. 7, 1982 describes an athletic bag having a valved, flexible container filled with water and gas under pressure providing a firmness and resistance to a blow delivered by a fist, hand or foot of a practitioner of any of the martial arts.

And finally, Soviet Patent Document 1720671 A1, dated March 1992, describes a punch bag with two coaxial sealed elongated chambers filled with substances of different specific gravities.

Notwithstanding the similarities of the exercise bags comprising the relevant prior art, unmet needs of exercise aficionados, particularly kick boxing devotees, remain for a durable, light-weight kick bag that is readily suspendable to provide a cushioned resistance target that can be readily dismantled and easily transported to gym, home or office.

SUMMARY OF THE INVENTION

Specifically, what is described herein is an exercise bag which comprises a suspendable enclosure, said enclosure having a top, a bottom and a continuously curving lateral side surface. Typically, the enclosure will be fabricated from a durable material able to endure arduous and protracted amounts of physical activity. The enclosure encompasses a padded structure, also designed to suffer the effects of repeated, regular physical forces and contacts. The padded structure, in turn, envelopes a resilient water-tight container, typically containing water, which can be removed and re-inserted at will.

DESCRIPTION OF THE PREFERRED EMBODIMENT

Figure 1:
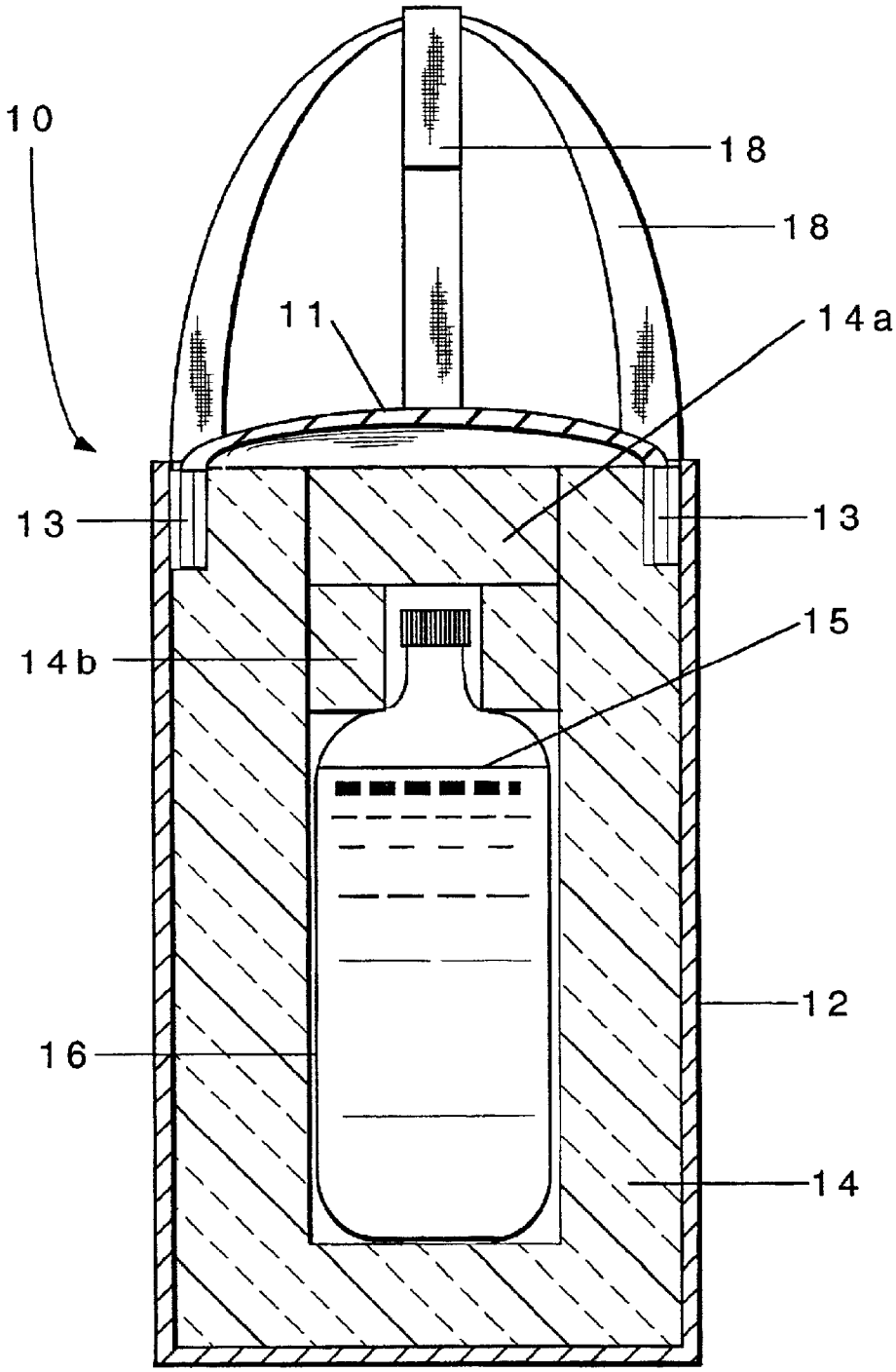
FIG. 1 is an elevated side view of the disclosed exercise bag in cross-section.

For a clear and complete understanding of the disclosed kick-boxing bag, reference should be made to the drawing.

Beginning with FIG. 1, the exercise bag 10 is depicted in its entirety. Typically, the bag will have a cylindrical shape and be about 50 centimeters in height. Readily apparent is the enclosure 12. The enclosure serves as the skin of the bag 10. It will incur all of the strikes and blows meted out by the practitioner as he kicks, jabs and chops the bag during his exercise regimen. Not surprisingly, the enclosure must be made of a durable material. Historically, most exercise, punching or speed bags were made of leather or canvas. Over the years, polyvinyl materials have become the enveloping material of choice. In addition to being durable, it is desirable for the enclosure to be relatively soft and gentle to the touch. Generally, heavily woven materials are too abrasive to the skin of the practitioner.

Within the enclosure 12, the exercise bag 10 contains padded structures 14, 14*a*, 14*b* and however many additional structures that may be required to adequately pad the exercise bag after the centerpiece 16 of the bag 10 has been inserted. The centerpiece 16 is a resilient plastic container, filled with a liquid, preferably water, that is inserted within the padded confines of the bag 10. Typically, the preferred centerpiece 16 is an empty two-liter soda pop container, filled with water to the shoulder 15 of the container and nestled within the padded structures 14*a, b*, etc.

For easy insertion into the padded confines of the bag, the enclosure 12 has a removable top 11. The top 11 can be held in place by a variety of fasteners, including buttons, zippers, snaps or the preferred hook and loop arrangement 13 depicted in FIG. 1. The point is that when removing or installing the centerpiece 16, the top 11 of the bag 10 can be removed to permit installation. To avoid removing all of the padding structure 14 within the bag, structures 14*a* and 14*b* have been cut or formed to permit selective removal so that the primary padded structure 14 can remain intact in the bag 10.

Figure 3:
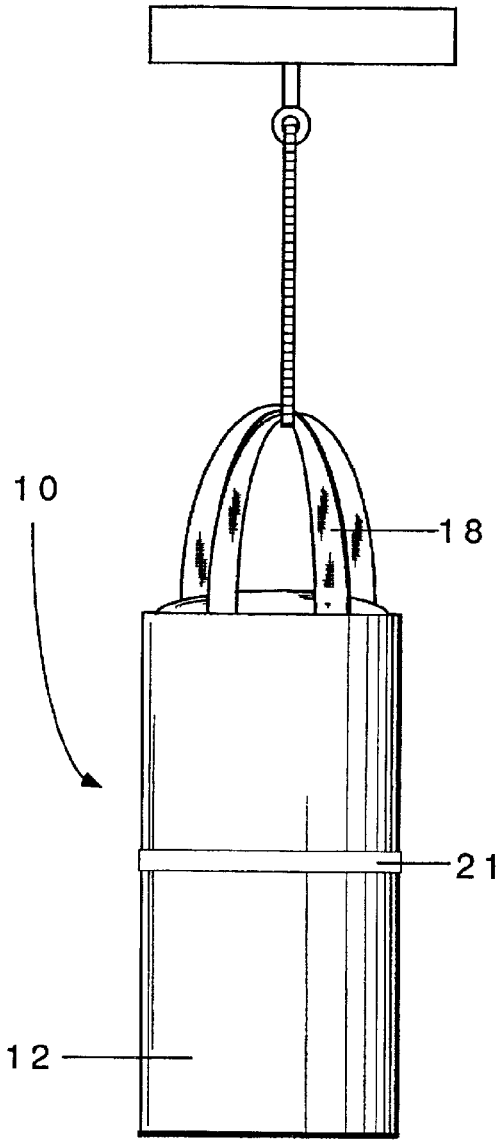
FIG. 3 is an elevated side view of the disclosed bag, suspended and ready for use.

To facilitate suspending the bag 10, as for example, in the middle of a room, or at least away from undesirable obstructions, the bag 10 can be hung as depicted in FIG. 3. The bag is ideally fitted with a suspending strap 18, and more than one strap is deemed to be even more desirable. The bag 10 can also be decorated and equipped with a circmferential stripe 21 to provide a target for the practitioner. Typically, the stripe 21 will be colored to contrast with the appearance of the enclosure 12.

Because the removable top 11 and padding 14 allow access to the vitals or interior of the bag 10, the centerpiece container 16 and its contents can be removed after a workout at the gym and the bag made lighter for the tote home. However, as a practical matter, removal of the container 16 will only be necessary during longer journeys when even a little extra weight can become a burden. But, after protracted pounding by the blows, jabs and kicks of the practitioner, the materials of the bag, and its components, may wear and weaken. Over time, the padding 14 may become compressed and it can be removed and replaced with new padding by simply removing the top 11 and making the exchange. Furthermore, the resilient centerpiece 16 may also weaken after hours of hard use and develop small cracks, which will ultimately leak the contents of the container. The eventual failure of the centerpiece container 16 is not seen as a design flaw. To the contrary, the concern is not if the container will fail, but when it fails. The centerpiece container 16, when filled with water to the recommended level 15 will compress and flex with each blow. Over time, the repeated compression will take its toll. And when it fails, the container 16 will it be easy and inexpensive to replace. After prolonged hard use, it is recommended and easy for the centerpiece container 16 to be removed and cursorily and routinely examined. When breaches are discerned, the availability and cost of a replacement centerpiece container 16 is not an issue and a "new" one can be readily inserted by removing convenient sections of the padding, e.g. 14*a* and 14*b*, and replacing them after the centerpiece container has been positioned.

Bear in mind that the shapes and locations of padding pieces 14*a* and 14*b* (and however many additional pieces of padding might be needed) are not important. All of the padding material 14 could be irregular and amorphous, but for purposes of aesthetics and ease of manufacturing assembly, regular, defined pieces of padding 14 are preferred, and, accordingly, are depicted in the drawing.

Figure 2:
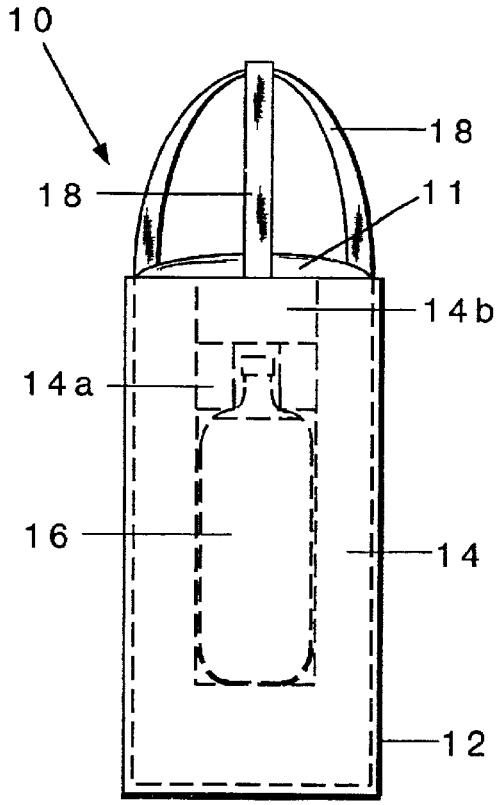
FIG. 2 is an elevated side view of the disclosed bag.
Figure 4:
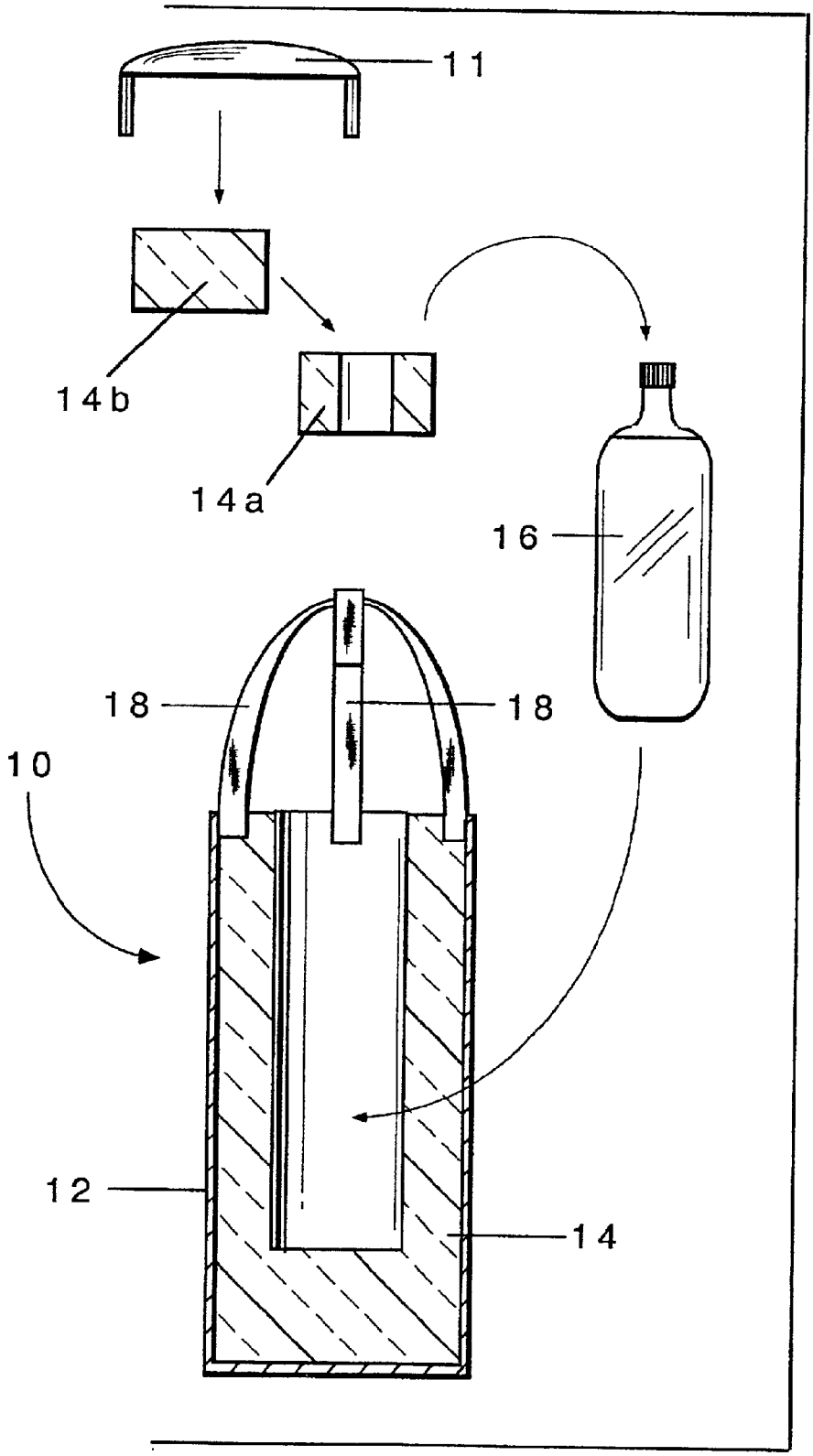
FIG. 4 is an elevated side view of the disclosed bag, in cross-section, disassembled.

FIGS. 2 and 4 should certainly remove all doubt as to the simple purpose and relationship of the padding 14, 14*a*, and 14*b* to the centerpiece container 16. At the risk of belaboring the painfully apparent, padding 14 can be shaped to accommodate the largest portion of the container 16, padding 14*b* can be shaped to accommodate the neck and padding 14*b* can be shaped to provide additional padding between the container 16 and the top 11 of the bag 10. And, again, this invention disclosure is not confined to placing particular pieces of padding in predetermined locations within the bag. The padding is intended to protect the hands and feet of the practitioner; and, of course, cushion the impact on the resilient centerpiece container 16. Clearly, the purposes of the padding 14, in this instance, far outweigh its form.

While the foregoing is a complete and detailed description of the preferred embodiment of the disclosed exercise bag, it should be apparent that numerous variations and modifications can be made and employed to implement the all-important purpose of the uniquely constituted bag without departing from the spirit of the invention, which is fairly defined by the appended claims.

What is claimed is:

1. A method of practicing a martial art routine which comprises: striking, with the foot, an exercise bag which comprises: an enclosure, said enclosure having a bottom, a removable top, and a continuously curving lateral side surface, said enclosure fabricated from a durable material and enclosing a padded structure, which, in turn, envelops a resilient, water-tight two-liter soda pop container that can be inserted and removed from the padded confines of the bag at will.

2. The method according to claim 1 wherein the padded structure of the exercise bag is an open cell foam.

* * * * *